US007431527B2

(12) United States Patent
Kroggel

(10) Patent No.: US 7,431,527 B2
(45) Date of Patent: Oct. 7, 2008

(54) PROMOTIONAL WRITING INSTRUMENT WITH BODY MASS INDEX CALCULATOR

(75) Inventor: Scott A. Kroggel, Garner, NC (US)

(73) Assignee: Adstracts, Inc., Raleigh, NC (US)

( * ) Notice: Subject to any disclaimer, the term of this patent is extended or adjusted under 35 U.S.C. 154(b) by 224 days.

(21) Appl. No.: 11/220,121

(22) Filed: Sep. 6, 2005

(65) Prior Publication Data

US 2007/0053739 A1 Mar. 8, 2007

(51) Int. Cl.
*B43K 29/00* (2006.01)

(52) U.S. Cl. ..... 401/195

(58) Field of Classification Search ..... 401/52, 401/195

See application file for complete search history.

(56) References Cited

U.S. PATENT DOCUMENTS 2,971,283 A * 2/1961 Parker ..... 40/334
3,937,939 A * 2/1976 Frenkel ..... 708/145
4,007,364 A 2/1977 Ojima et al.
4,128,889 A 12/1978 Ojima et al.
4,141,073 A 2/1979 Tan
4,241,409 A 12/1980 Nolf
D303,124 S 8/1989 Li
4,948,284 A 8/1990 Lingott
5,028,764 A 7/1991 Kuhlengel
6,104,603 A 8/2000 Wang
6,273,626 B1 * 8/2001 Yazawa ..... 401/6
6,468,209 B1 10/2002 Heymsfield et al.
6,890,117 B2 5/2005 Hazzard
2006/0282486 A1 * 12/2006 Bhavnani et al. ..... 708/160

* cited by examiner

*Primary Examiner*—Huyen Le
(74) *Attorney, Agent, or Firm*—Myers Bigel Sibley & Sajovec, P.A.

(57) ABSTRACT

A promotional writing instrument includes an elongated barrel having opposite first and second ends, a writing element located at the first end, and an electronic body mass index (BMI) calculator located at the second end that is configured to display a BMI number in response to user entry of weight and height data. The BMI calculator includes a housing having opposite front and rear faces, opposite first and second sides, and a free end portion. A display is viewable through the housing front face. A processor is disposed within the housing that calculates and displays, via the display, a BMI number in response to user entry of weight and height data. A user control is operably connected with the processor and located adjacent the display.

8 Claims, 4 Drawing Sheets

PROMOTIONAL WRITING INSTRUMENT WITH BODY MASS INDEX CALCULATOR

FIELD OF THE INVENTION

The present invention relates generally to product and service promotion and, more particularly, to the promotional writing instruments.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle"with other promotional articles. Thus, there is a need for distinctive, more effective promotional products directed to healthcare providers as well as to others.

SUMMARY OF THE INVENTION

In view of the above discussion, a writing instrument is provided that includes an elongated barrel having opposite first and second ends, a writing element located at the first end, and an electronic body mass index (BMI) calculator located at the second end that is configured to display a BMI number in response to user entry of weight and height data. The BMI calculator includes a housing having opposite front and rear faces, opposite first and second sides, and a free end portion. A display is viewable through the housing front face. A processor is disposed within the housing that calculates and displays, via the display, a BMI number in response to user entry of weight and height data. A user control is operably connected with the processor and located adjacent the display. The user control allows a user to quickly and easily input weight and height data into the processor.

DETAILED DESCRIPTION OF THE INVENTION

Figure 1:
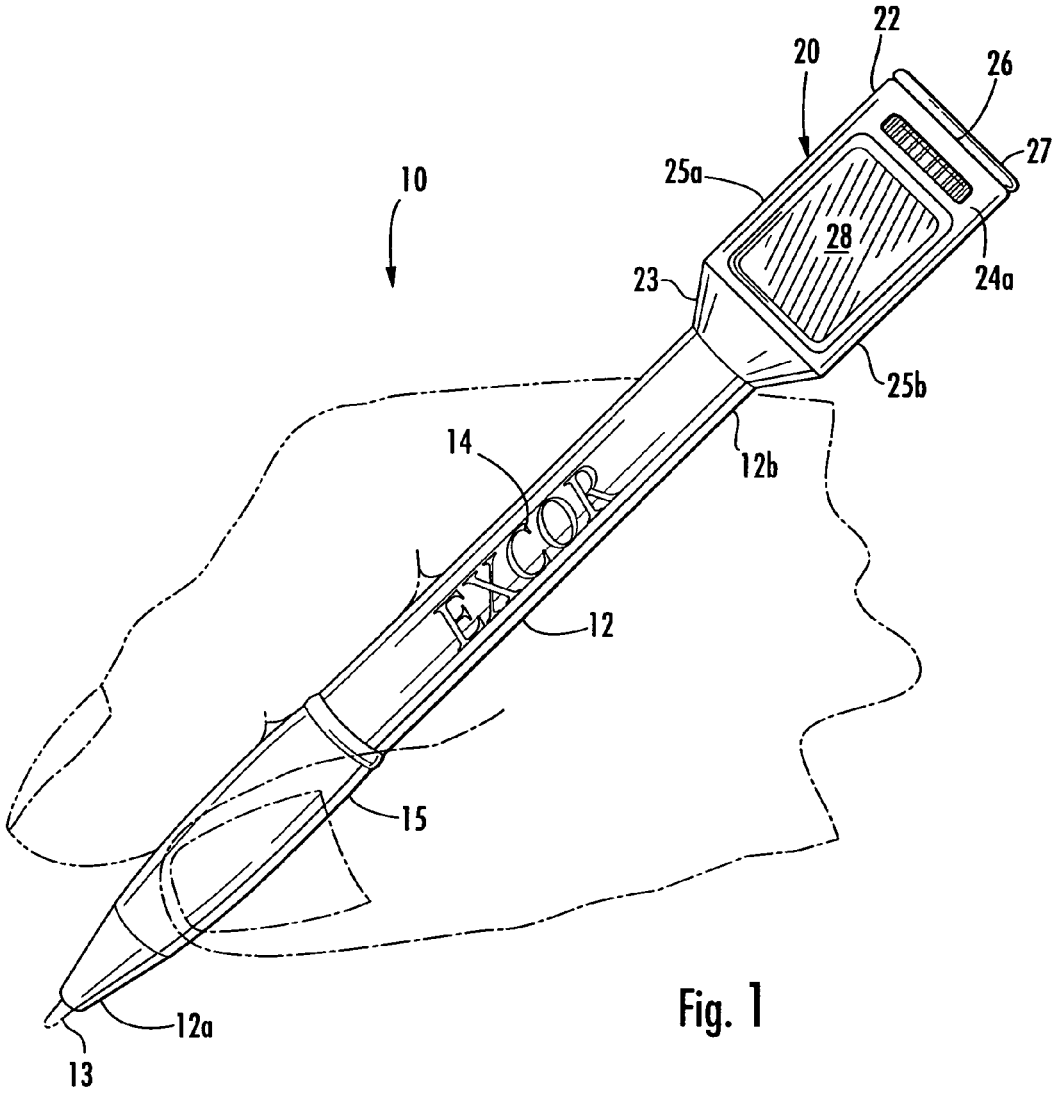
FIG. 1 is perspective view of a writing instrument, according to embodiments of the present invention.
Figure 2:
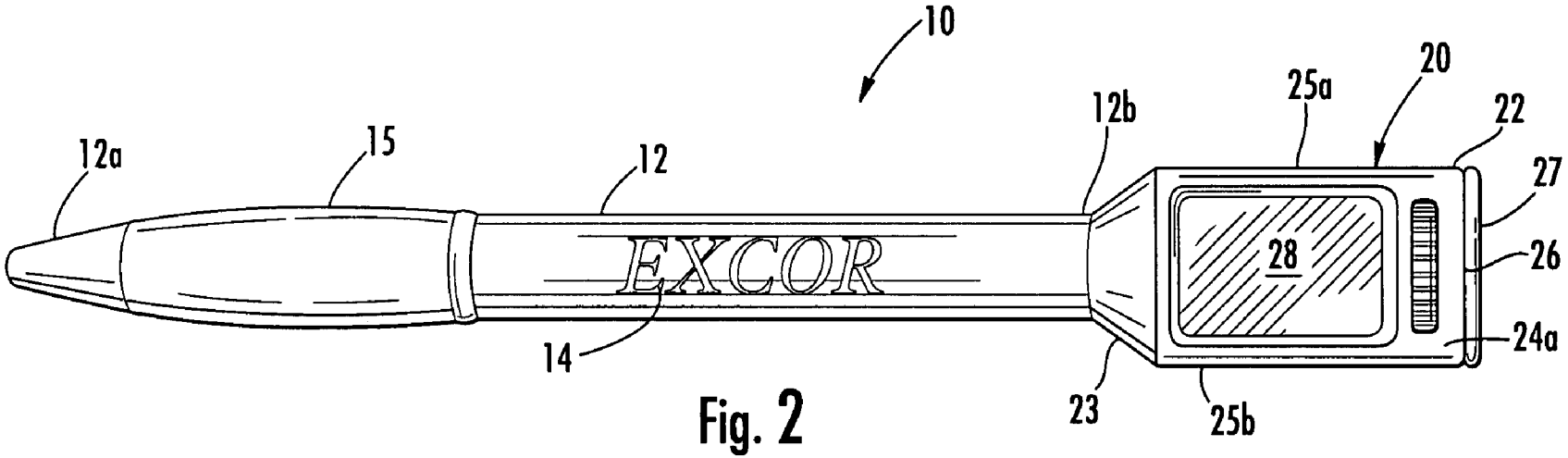
FIG. 2 is a front plan view of the writing instrument of FIG. 1.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention.

Referring now to FIGS. 1-4, a writing instrument 10 according to an embodiment of the present invention is illustrated. The illustrated writing instrument 10 includes an elongated barrel portion 12 with a first end 12*a* and an opposite second end 12*b*. A writing element 13 is extended and retracted through the first end 12*a*. Various types of writing elements (e.g., flair-tip writing elements, ball-point writing elements, pencil writing elements, etc.) may be utilized in accordance with embodiments of the present invention. Moreover, writing element 13 can permanently extend from the barrel first end 12*a* (i.e., the writing element 13 need not be retractable within the barrel 12). Writing elements are well known to those of skill in the art, and will not be further described herein.

The illustrated barrel portion 12 has a generally cylindrical configuration. However, writing instruments according to embodiments of the present invention may have barrels with various other shapes and configurations, without limitation. The illustrated barrel portion 12 includes promotional indicia 14 disposed thereon. Various types of promotional indicia including, but not limited to, lettering, designs, characters, logos and other symbols, may be utilized in accordance with embodiments of the present invention. The term "lettering" as used herein includes, but is not limited to, alphabetical characters and alphanumeric characters. Moreover, promotional indicia may be utilized virtually anywhere on the writing instrument 10. Embodiments of the present invention are not limited to the illustrated location and configuration of promotional indicia 14.

The illustrated barrel portion 12 includes a finger grip portion 15 adjacent the writing end 12*a*. The finger grip portion 15 may be formed from a resilient, deformable material that is effective to prevent slippage of a user's fingers during operation of the writing instrument 10. The finger grip portion 15 may have various shapes and configurations and may be formed from various materials, without limitation.

The writing instrument 10 includes an electronic body mass index (BMI) calculator 20 at the barrel second end 12*b*. The BMI calculator 20 is configured to display a BMI number in response to user entry of a person's weight and height. The BMI calculator 20 may be configured to display various other types information, including information associated with a displayed BMI number. For example, information that explains the meaning of a displayed BMI number may be displayed.

As would be understood by those skilled in the art, the BMI of a person is conventionally calculated using the person's height and weight. For example, BMI may be calculated using the equation: $M/L^2$, where M is body weight in pounds, and L is the body height in feet. Various other equations may be used for calculating a BMI, however. A BMI can be a useful indicator of a person's body composition and can be used in various applications. For example, health-care providers can use a person's BMI to determine the proper amount of medication to prescribe for that person.

The illustrated BMI calculator 20 includes a housing 22 having opposite front and rear faces 24*a*, 24*b*, opposite first and second sides 25*a*, 25*b*, and a free end portion 26. The housing 22 is connected to the barrel second end 12*b* via a tapered neck section 23, as illustrated. In the illustrated embodiment, the front and rear faces 24*a*, 24*b* have generally rectangular configurations. The first and second sides 25*a*, 25*b* have generally rectangular configurations, and the free end portion 26 has a generally rectangular configuration. However, embodiments of the present invention are not limited to the illustrated configuration of housing 22. The front and rear faces 24*a*, 24*b*, first and second sides 25*a*, 25*b*, and the free end portion 26 may each have any of various configurations.

Figure 3:
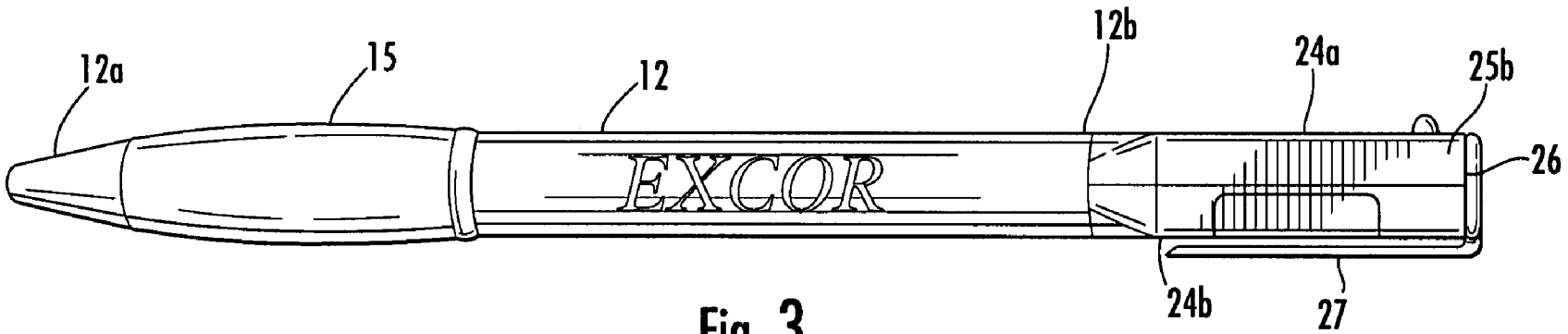
FIG. 3 is a side plan view of the writing instrument of FIG. 1.
Figure 4:
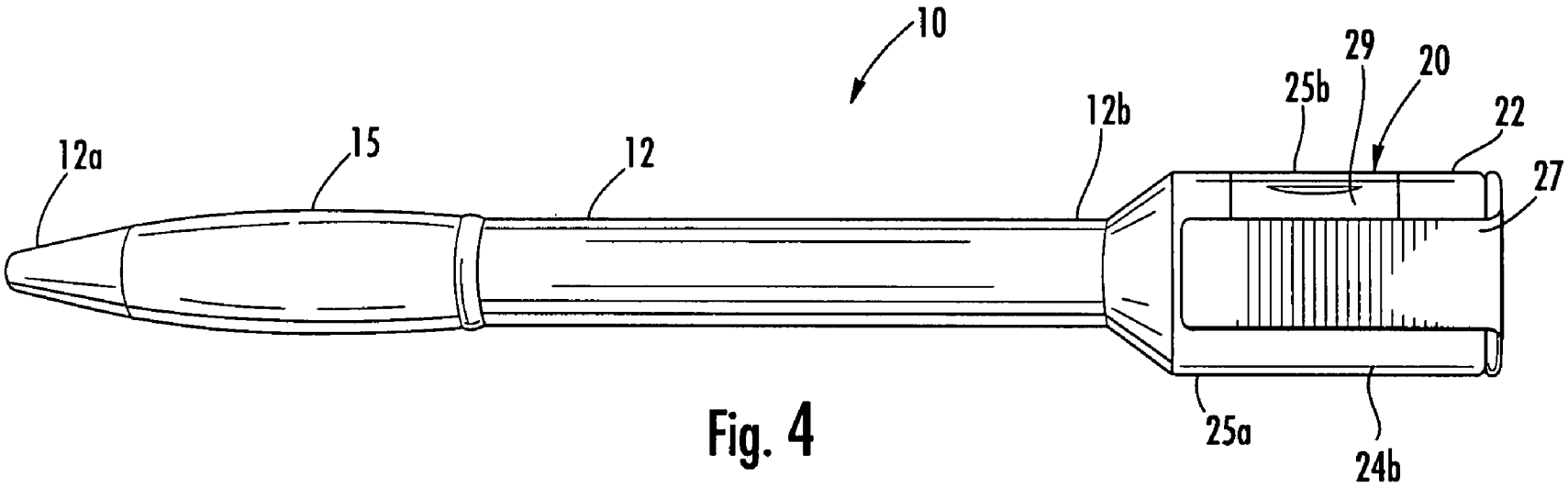
FIG. 4 is a rear plan view of the writing instrument of FIG. 1.

As illustrated in FIGS. 3 and 4, the writing instrument 10 also includes a clip 27 attached to the BMI calculator housing 22 that is configured to removably attach the writing instrument 10 to an object. The illustrated clip 27 is attached to the housing free end portion 26 and extends along the housing rear face 24*b* in adjacent spaced apart relationship.

The illustrated BMI calculator 20 includes a display 28 that is viewable through the housing front face 24*a*. A processor (not shown) is located within the housing 22 and is configured to calculate and display, via the display 28, a BMI number in response to user entry of weight and height data. A power source (e.g., battery) is also located within the housing 22 to power the processor and display 28, as would be understood by those skilled in the art. The power source is accessible via door 29 in the housing rear face 24*b*.

A user control 30 is operably connected with the processor and extends outwardly from the housing front face 24*a* adjacent the display 28, as illustrated. The user control 30 allows a user to input weight and height data into the processor so that the processor can then generate a BMI number. In the illustrated embodiment, the user control 30 is an input wheel 32 that is rotatably mounted to the housing 22 and that is configured to generate input signals to the processor when rotated and/or pushed by a user. Various types of user controls may be utilized. Embodiments of the present invention are not limited to the illustrated user control 30.

Figure 6:
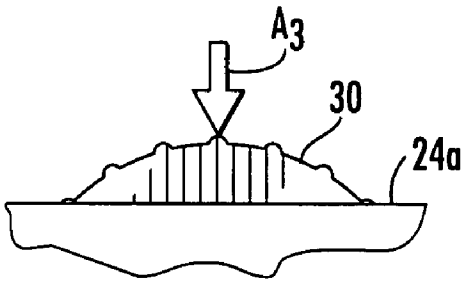
FIGS. 5-6 illustrate operation of a user control for entering weight and height data into the BMI calculator of the writing instrument of FIG. 1.
Figure 5:
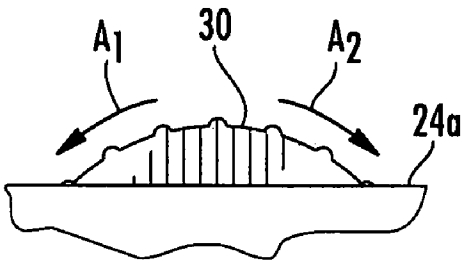
Figure 7:
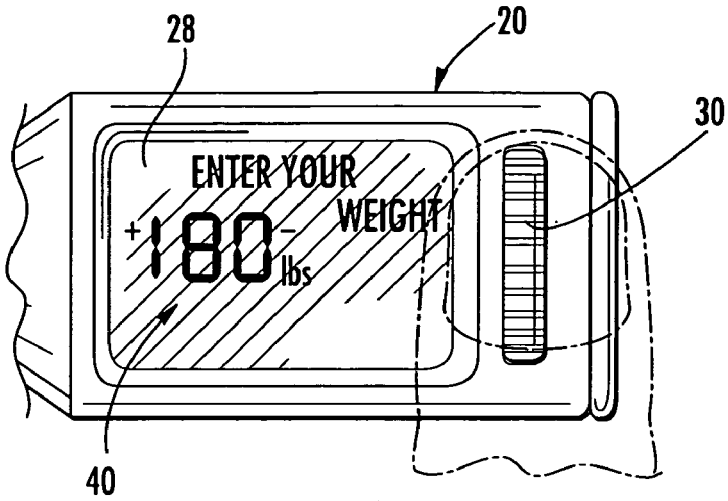
FIGS. 7-9 are partial plan views of the writing instrument of FIG. 1 that illustrate the display of the BMI calculator.
Figure 8:
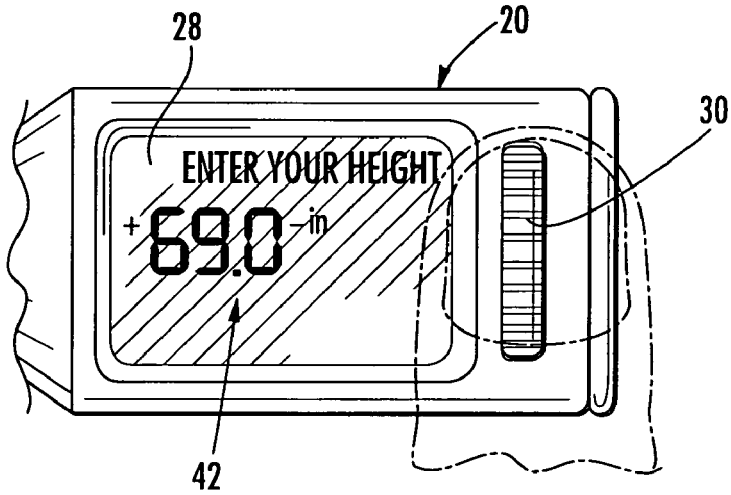
Figure 9:
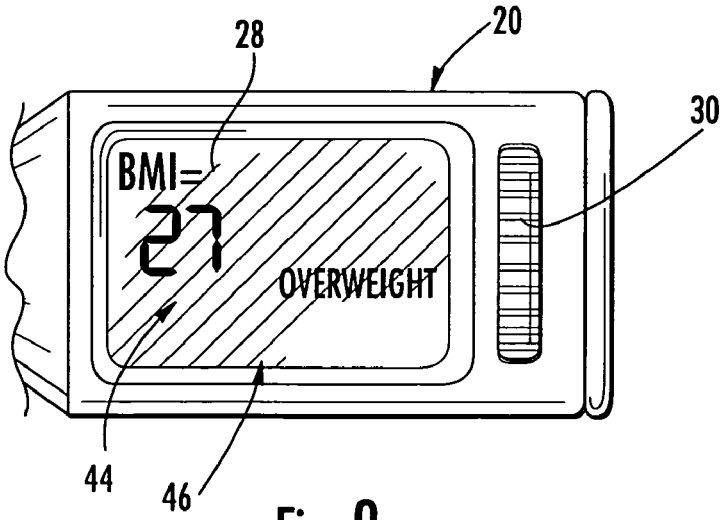

FIGS. 5 and 6 illustrate user operation of the user control 30. A user can rotate the wheel 32 in either direction, as indicated by arrows $A_1$ and $A_2$, to increase or decrease a displayed value, such as weight and height. When the desired value is displayed, the user presses the wheel 32 as illustrated in FIG. 6 by arrow $A_3$ to "enter" the displayed value into the processor. For example, in FIG. 7, a user has entered, via user control 30, a weight of 180 lbs (indicia 40). In FIG. 8, a user has entered, via user control 30, a height of 5'9" (indicia 42). In FIG. 9, a BMI number 27 (indicia 44) has been calculated by the processor and is displayed with additional information, such as weight status (indicia 46). As used herein, the term "weight status" means whether a person is underweight, healthy, over weight, obese, etc., based upon the person's BMI number.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. The invention is defined by the following claims, with equivalents of the claims to be included therein.

That which is claimed is:

1. A writing instrument, comprising:

an elongated barrel having opposite first and second ends;

a writing element located at the first end; and an electronic body mass index calculator located within a housing positioned at the barrel second end, wherein the housing comprises opposite front and rear generally rectangular faces, opposite first and second generally rectangular sides, and a generally rectangular end portion, wherein the body mass index calculator comprises:

a display viewable through the housing front face;

a processor configured to prompt a user to enter weight and height data, and configured to calculate and display, via the display, a body mass index number in response to user entry of weight and height data; and a user control operably connected with the processor and that extends from the housing front face adjacent the display, wherein the user control allows a user to input weight and height data into the processor after a prompt by the processor, and wherein the user control comprises an input wheel rotatably mounted to the writing instrument that is configured to generate input signals to the processor when rotated and/or pushed.

2. The writing instrument of claim 1, wherein the body mass index calculator is configured to display weight status adjacent to a displayed body mass index number in response to user entry of weight and height data.

3. The writing instrument of claim 1, further comprising promotional indicia disposed thereon.

4. The writing instrument of claim 1, wherein the barrel comprises a finger grip portion adjacent the writing end, wherein the finger grip portion comprises resilient, deformable material.

5. The writing instrument of claim 1, wherein the display comprises a liquid crystal display.

6. A writing instrument, comprising:

an elongated barrel comprising opposite first and second ends;

a writing element located at the first end; and a calculator located at the second end that comprises:

a display;

a processor having a preprogrammed mathematical formula, wherein the processor is configured to prompt a user to enter at least one numerical value, wherein the processor is configured to utilize the preprogrammed mathematical formula to calculate a result in response to user entry of the at least one numerical value, and wherein the processor is configured to display the result via the display; and a user control operably connected with the processor that allows a user to input the at least one numerical value into the processor when prompted by the processor, wherein the user control comprises an input wheel rotatably mounted to the writing instrument and that is configured to generate input signals to the processor when rotated and/or pushed by a user.

7. The writing instrument of claim 6, wherein the preprogrammed mathematical formula is a body mass index formula, wherein the processor is configured to prompt a user to enter weight and height data, and wherein the processor is configured to calculate and display, via the display, a body mass index number in response to user entry of weight and height via the user control.

8. The writing instrument of claim 7, wherein the processor is configured to display weight status adjacent to a displayed body mass index number in response to user entry of weight and height data.

* * * * *